United States Patent [19]

Schultes et al.

[11] 4,077,420

[45] Mar. 7, 1978

[54] SHORTENABLE UMBRELLA

[75] Inventors: Tilmann Schultes; Joachim Seidel, both of Solingen, Germany

[73] Assignee: Kortenbach & Rauh Kommanditgesellschaft, Solingen, Germany

[21] Appl. No.: 784,977

[22] Filed: Apr. 6, 1977

[30] Foreign Application Priority Data

Apr. 10, 1976 Germany ..... 2615731

[51] Int. Cl.[2] ..... A45B 19/04

[52] U.S. Cl. ..... 135/25 R; 135/26; 135/27

[58] Field of Search ..... 135/25 R, 25 A, 26, 135/27

[56] References Cited

U.S. PATENT DOCUMENTS

| | | | |
|---|---|---|---|
| 1,249,007 | 12/1917 | Block | 135/25 R |
| 2,649,103 | 8/1953 | Militano | 135/25 R |
| 3,902,514 | 9/1975 | Weber | 135/25 R |
| 4,007,752 | 2/1977 | Weber | 135/25 R |
| 4,030,514 | 6/1977 | Schultes | 135/25 A X |
| 4,030,515 | 6/1977 | Weber | 135/26 |

*Primary Examiner*—Werner H. Schroeder
*Assistant Examiner*—Conrad L. Berman
*Attorney, Agent, or Firm*—Martin A. Farber

[57] ABSTRACT

A shortenable umbrella with blades carrying the umbrella canopy, the blades being shortenable by telescoping and/or folding, of which the innermost blade parts are pivoted on a crown secured on a shortenable rod assembly and respectively are horizontally pivotable by means of at least one fork by means of at least one slider, whereby each outermost blade part is hinged foldable onto the adjacent blade part by means of a control rod which acts on an extension of the outermost blade part. The inner-lying end of each control rod surrounds the fork associated therewith by means of a guide opening which is large in area with respect to the cross-section of the fork, the guide opening making possible a displacement of the inner-lying end of the control rod in the longitudinal direction of the fork and/or of the control rod.

6 Claims, 13 Drawing Figures

Figure 5:
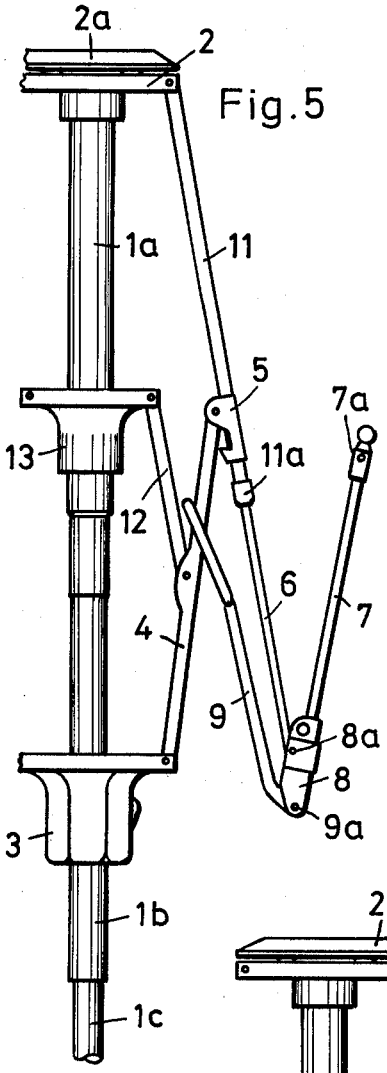

Fig.1
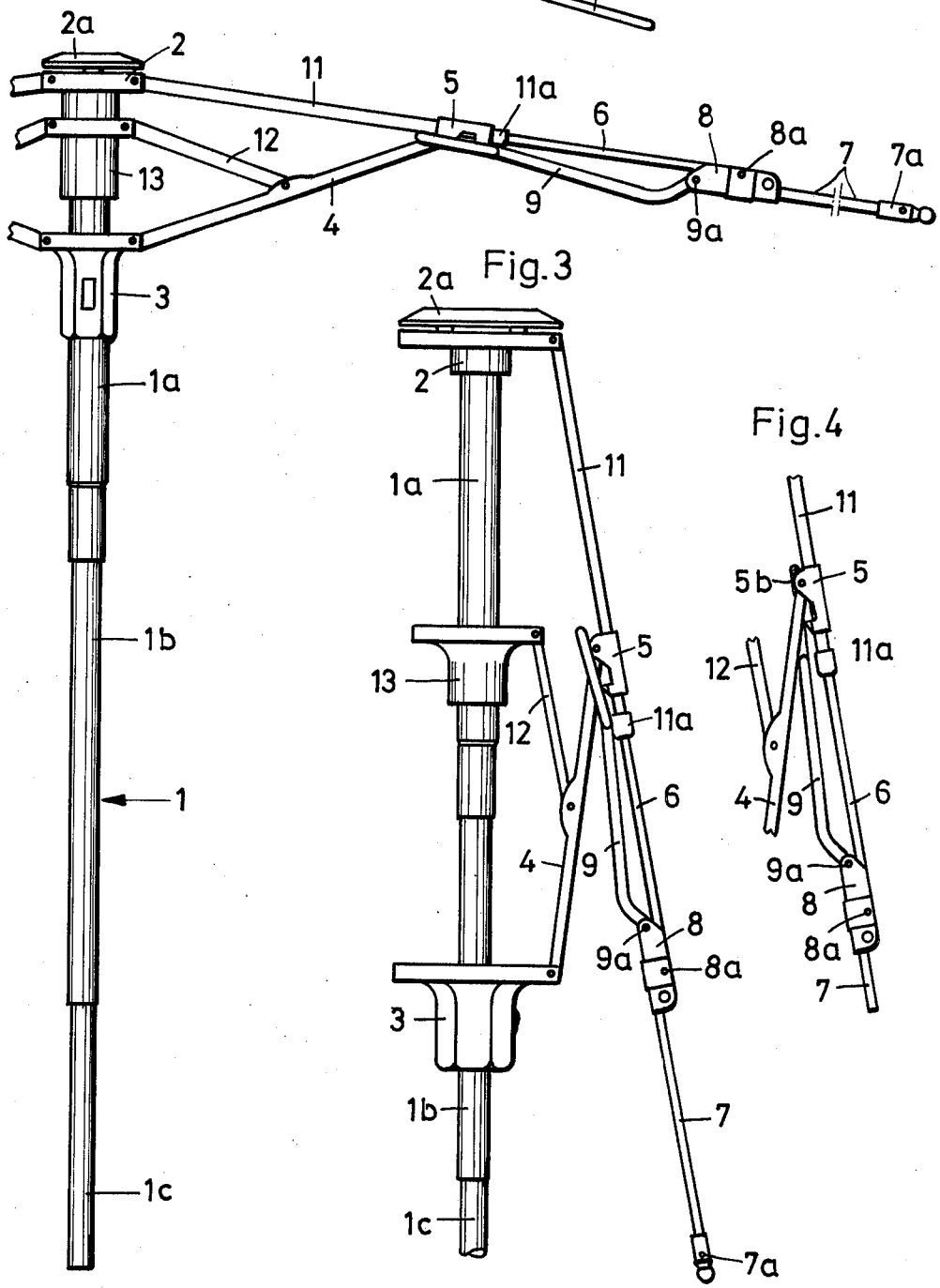
Fig.2
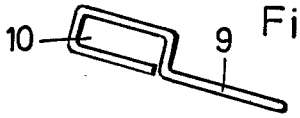
Fig.3
Fig.4

Fig.8
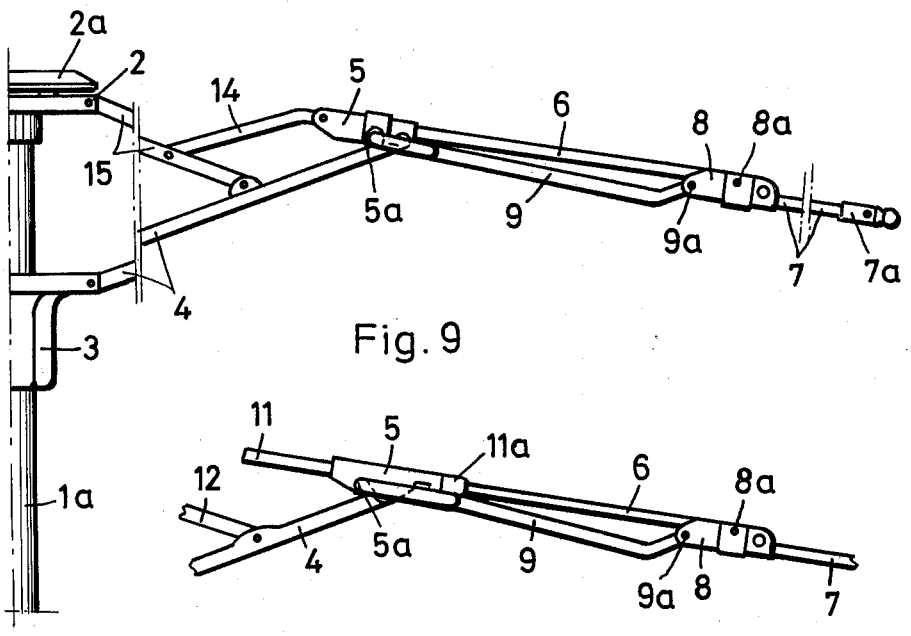
Fig. 9
Fig.10
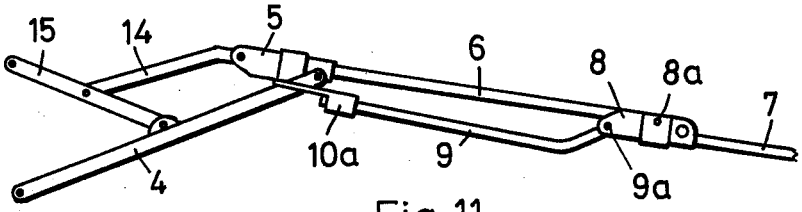
Fig.11
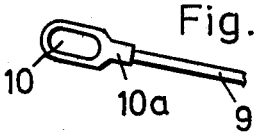
Fig.12
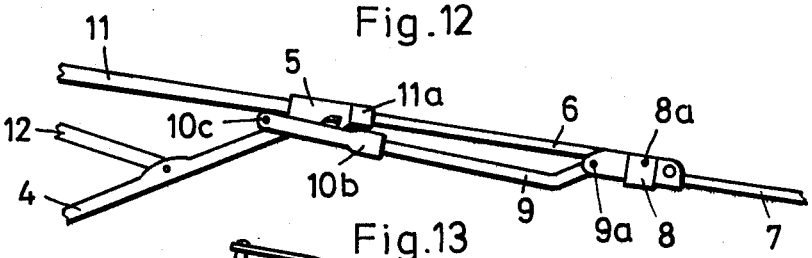
Fig.13
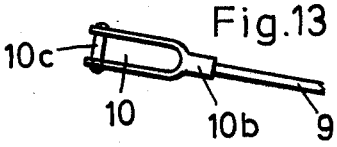

SHORTENABLE UMBRELLA

The invention relates to a shortenable umbrella with blades carrying the umbrella canopy, the blades being shortenable by telescoping and/or folding, of which the innermost blade parts are pivoted on a crown secured on a shortenable rod assembly and respectively are horizontally pivotable by means of at least one fork by means of at least one slider, whereby each outermost blade part is foldably articulated on the adjacent blade part by means of a control rod which acts on an extension of the outermost blade part.

Shortenable or contractable umbrellas of the previously mentioned type are known with telescopic canopy rod ribs or blades as well as with scissors-like joint folding or collapsible frame blades. With both designs the folded down blade parts have a tendency during the opening of the umbrella to fold back into the folded-up position, whereby the outer ring of the umbrella canopy is folded up. This is eliminated by the known embodiments by use of control rods which engage respectively on an extension of the outermost foldable-down blade part and force a positive or constrained folding down movement of this outermost blade part during opening of the umbrella.

In order to adjust or correlate the course of movement produced by the control rods to the movement of the remaining frame parts, with the known embodiments it is necessary either to arrange resilient intermediate elements or to provide an elongated hole connection between the outer-lying end of the control rod and the extension on the inner-lying end of the foldable blade part. While the design with an elongated hole connection has the disadvantages that the folding movement of the outermost blade parts is only imperfectly controlled, with the design having the resilient intermediate elements there exists the disadvantage that it is expensive in production as well as during assembly and beyond that it is particularly susceptible to trouble or failure to a marked degree.

In order to avoid these disadvantages and to effect a positive forceful constrained folding-down of the outermost blade parts without the use of resilient intermediate elements or to effect the elongated hole connections compensating the control movement, it has already been proposed to pivotally fasten the inner end of the control rods respectively on a slide hinge which is articulated on the fork by means of a connection rod. In this manner the advantage is obtained that by means of fixed connections, an early folding-down of the outermost blade parts is achieved and the outermost umbrella cover ring is prevented from folding back.

By the use of control rods it is altogether not possible with the above-mentioned explained embodiments to close the umbrella with the outermost blade parts folded-down. Such a condition with folded-up together umbrella canopy and fully extended frame parts is desired when the umbrella cover is supposed to be dry after use, without the existence of the possibility to open the umbrella canopy.

The invention is based on the task, with a shortenable umbrella of the introductory described type, while keeping an early folding-down of the outermost blade parts during the opening of the umbrella, to provide the possibility during the closing of the umbrella selectively to load the outermost blade parts in the folded-down position or to fold-back the outermost blade parts for the engagement or abutment on the adjacent blade parts.

This task is solved with the invention in the manner that the inner-lying end of each control rod embraces the associated fork by means of an area guide opening which is large with respect to the cross-section of the fork, the guide opening making possible a displacement of the inner-lying end of the control rod in the longitudinal direction of the fork and/or of the control rod.

With this proposal of the invention, the advantage is achieved that a very early folding-down of the outermost blade parts is attained during the opening of the umbrella, since at the beginning of the opening movement the inner-lying end of each control rod shifts along the spreading fork, whereby the lever arm for the control movement, the latter which is exerted on the outermost blade part by means of the control rod, is considerably increased. At the end of the opening movement, the inner-lying end of each control rod slides back along the fork into a position in which the control rod is located approximately parallel to that blade part which is adjacent to the outermost blade part. In this manner, automatically an equalization or compensation is attained, in that the outermost blade parts at the beginning of the opening movement executed an increased folding-down movement. During the closing of the umbrella, the guide opening formed on the inner-lying end of each control rod makes it possible for the outermost blade parts to remain selectively in the folded-down position or to be folded up on the adjacent blade parts, since this large area guide opening facilitates a shifting of the inner-lying end of the control rods in the longitudinal direction of the fork as well as of the control rod, so that independent of the respective position at the time, the outermost ring of the umbrella canopy can be folded back or can remain in the extended position. It is thus possible by the inventive formation with maintaining of an early folding-down movement of the outermost blade parts during opening, for the user to decide whether he wants to fold the outer canopy ring back during the closing of the umbrella or to load it into a stretched or extended position. The slide movement of the inner-lying end of each control rod on the associated fork which takes place during the opening increases the early folding-down movement of the outermost blade parts, so that the inventive formation also with respect to this has advantages compared to the known embodiments.

The above-described advantages of the invention are achieved with simplest technical means, particularly without additional or failure prone construction parts. According to the invention, the guide opening can be formed either by means of a control piece mounted on the inner-lying end of the control rod or integrally by means of a plurality of bend-off portions of the inner-lying end of the control rod.

The part of the control rod forming the guide opening according to a further feature of the invention can be bent-off relative to the longitutinal direction of the control rod with the formation of an acute angle, whereby with an opened umbrella a bending of the control rod occurs opposite to the bend-off, which insures that with the closing of the umbrella the inner lying-end of each control rod becomes free or releases behind the hinge by the inherent resiliency of the control rod, with which hinge the fork is connected with the blades forming the umbrella cover. In this manner independent of the hinge formation, it is guaranteed that a jamming of the control rod is prevented.

According to a further feature of the invention, the inner-lying end of the control rod, with the stretched out umbrella, can lie in a recess which is formed in the hinge, the latter which pivotally connects the fork with the blades. By this recess, in spite of the normally free moveability of the control rod relative to the fork, it is possible to expose the control rod to a compressive or pressure loading with the stretched out umbrella, whereby an increased resistance against bending is achieved of the entire outer blade system.

The construction according to the invention is not only useable with shortenable umbrellas, whose blades which carry the umbrella canopy are shortenable or collapsible at least by a factor of two by telescoping or folding back; the invention also permits use with simple folding umbrellas which consist of a blade part connected with the fork and a foldable-down outermost blade part.

Figure 6:
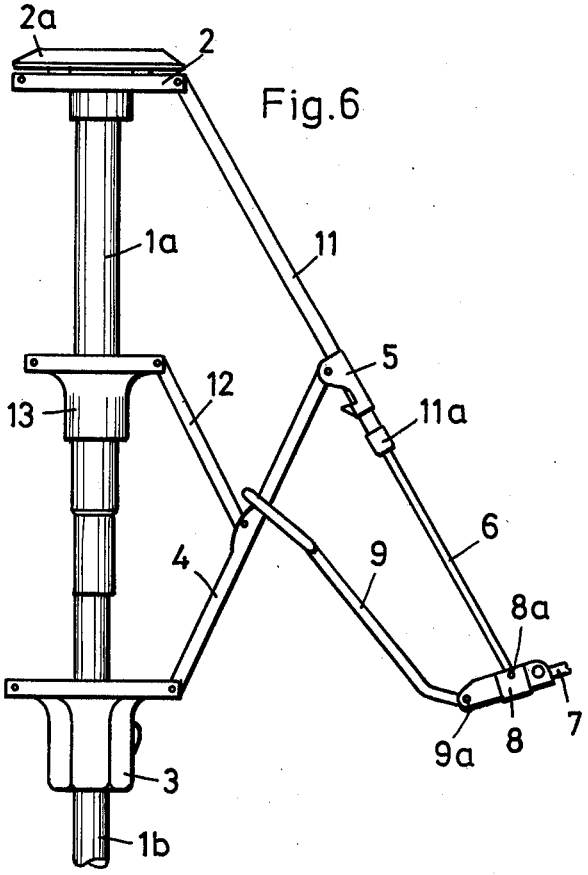
Figure 7:
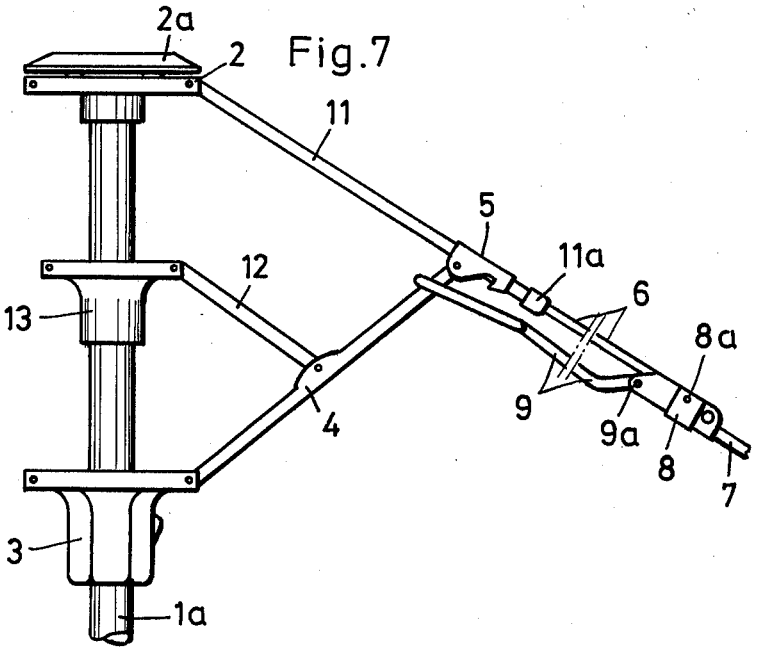

Various embodiment examples of the invention are illustrated on the drawing, and indeed show:

FIG. 1 a first embodiment example of a triple-shortenable umbrella in the stretched out condition, the outermost blade parts of which are foldable and the inner-lying blade parts of which are telescopicable, FIG. 2 a plan view on the inner-lying end of the control rod according to FIG. 1, FIG. 3 the umbrella illustrated in FIG. 1 in the almost closed position with folded-down outermost blade parts, FIG. 4 the umbrella illustrated in FIG. 3 in the nearly closed position with folded-down outermost blade parts and a particularity on the hinge, FIG. 5 an illustration corresponding to FIG. 3, by which however the outermost blade parts are almost folded-up, FIG. 6 the umbrella illustrated in FIGS. 1 to 5 at the start of the opening operation, FIG. 7 an illustration corresponding to FIG. 6 with further advanced opening operation, FIG. 8 a second embodiment of an umbrella illustrated in the spread out condition, the inner-lying blade parts of which are foldable scissors-like, FIG. 9 a partial illustration corresponding to FIG. 8 of a frame which is telescopical with respect to the inner-lying blades, FIG. 10 an illustration corresponding to FIG. 8 with a varied embodiment of the control rod, FIG. 11 a plan view of the inner-lying end of the control rod according to FIG. 10, FIG. 12 a further embodiment possibility for the control rod, and FIG. 13 a plan view of the inner-lying end of the control rod according to FIG. 12.

The embodiment illustrated in FIGS. 1 to 7 relates to a so-called flat umbrella with a three part rod assembly 1 which comprises an outer tube 1*a*, a center tube 1*b*, and an inner tube 1*c*, which are telescopically guided within each other. A crown 2 is secured at the free end of the outer tube 1*a*, on which crown the umbrella cover, which is not illustrated in the drawing, is fixed by means of a cap or top 2*a*. Further, a slider 3 is moveably arranged on the outer tube 1*a* of the rod assembly 1. A plurality of forks 4 are articulated to the slider 3. Only one fork 4 is completely illustrated in the drawings for the sake of an improved overall view.

The outer end of each fork 4 is articulated on a hinge 5, the latter being fastened on the inner-lying end of a middle blade part 6. A folding hinge 8 is articulated by means of a folding pin 8*a* on the outer end of this blade part 6, the folding hinge 8 being attached to the inner-lying end of an outermost blade part 7. The outermost blade part 7 is arranged so as to be foldable on the middle blade part 6 with the aid of the folding hinge 8, whereby the folding movement can be controlled by means of a control rod 9 which is articulated by means of a pivot or hinge pin 9*a* on that part of the folding hinge 8 which is inwardly extended across or beyond the folding pin 8*a*. For fastening of the umbrella cover, each outermost blade part 7 is provided with a blade top end cap 7*a*, and a sew- or tie-on hole on the folding hinge 8.

The inner-lying end of each control rod 9 encompasses or engages around the fork 4 which is coordinated thereto, by means of a guide opening 10 (see FIG. 2), which guide opening in proportion to the cross-section of the fork 4 has a large area and which makes possible a displacement of the inner-lying end of the control rod 9 in the longitudinal direction of the fork as well as in the longitudinal direction of the control rod 9. In this manner, a guiding of the inner-lying end of the control rod 9 takes place on the fork 4, the guiding permitting a large movement play space.

The shortenable umbrella, according to FIGS. 1 to 7, is constructed as a telescopic umbrella and has an innermost blade part 11 in which the middle blade part 6 telescopically can be pushed. This innermost blade part 11 is pivotably articulated with its inner-lying end on the crown 2. The blade part 11 on the outermost-lying end carries a small band 11*a* on which the hinge 5 (which is fastened to the middle blade part 6) comes into contact or engagement with an opened umbrella, as illustrated in FIG. 1. Finally the umbrella, according to FIGS. 1 and 2 has auxiliary forks 12 which are articulated on the forks 4, the auxiliary forks 12 being horizontally pivotable by means of an auxiliary slider 13.

With an opened umbrella, that means with a stretched out umbrella cover, the control rod 9 lies in the vertex of the acute angle which is formed by the fork 4 and the innermost blade part 11. In this position, consequently a movement of the control rod 9 is prevented. The foldable-down outermost blade part 7 is located in the unfolded position so that an orderly stretching of the umbrella cover is guaranteed.

With a closed umbrella according to FIGS. 3 and 5 the possibility exists, either to transfer the outermost blade parts into the folded-down position (FIG. 3), or to fold-up the outermost blade parts on the middle blade parts 6 (FIG. 5), since in this position the guide opening 10 permits a movement of the control rod 9 in its longitudinal direction, whereby a movement of the outermost blade part 7 about the folding pin 8*a* of the folding hinge 8 is possible. The user of the umbrella consequently has the choice whether he wants to fold back the outer ring of the umbrella cover according to FIG. 5, the outer ring being fastened on the folding hinge 8 and the pole cap 7*a*, or to load it into the extended position according to FIG. 3.

In spite of the large movement, possibility of the control rod 9 with respect to the fork 4, with the opening of the umbrella, the desired control movement for the outermost blade parts 7 automatically occurs. FIGS. 6 and 7 illustrate that during the beginning of the opening operation each control rod 9 slides with its guide opening 10 on the associated fork 4 in the direction toward the slider 3. By the thereby resulting large spacing of the inner end of the control rod 9 away from the hinge 5 there is brought about a larger lever arm for the folding movement, the latter being exerted on the outermost blade part 7, by means of the control rod 9, so that the outermost blade part 7 is folded-down altogether very early out from its parallel position to the middle blade part 6. This movement operation not only prevents a remaining behind or lagging of the outer ring of the umbrella, but rather altogether favors the movement course during the opening of the umbrella cover. Only near the end of the opening movement, does the inner-lying end of the control rod 9 according to FIG. 7 slide back on the fork 4 in the direction toward the hinge 5. In this manner, the necessary movement equalization or compensation occurs with respect to the folding movement of the outermost blade parts 7. With a completely opened umbrella, the inner-lying end of the control rod 9 with the guide opening 10 lies directly behind the hinge 5.

In order to avoid a jamming of the guide opening 10 behind this hinge 5, by the illustrated embodiment according to FIGS. 1, 3, 5, 6 and 7, the part of the control rod 9 which forms the guide opening 10, is bent off relative to the longitudinal direction of the control rod 9 forming an acute angle, as this is clearly shown in FIGS. 3, 5, 6 and 7.

With the completely opened umbrella according to FIG. 1, this bend provides for the production of an elastic force within the control rod 9, as this is be recognized in FIG. 1 by the almost stretched or straightened position of the part of the control rod 9 which forms the guide opening 10. When the umbrella is closed from this position, this elastic force causes the inner-lying end of the guide opening 10 to reliably come out from behind the hinge 5, so that the guide opening 10 does not jam behind the hinge 5, but rather can slide freely on the fork 4.

While in FIGS. 1, 3, 5, 6 and 7, the jamming of the guide opening 10 in back of the hinge 5 is prevented by formation of the acute angle on the control rod 9, FIG. 4 shows an embodiment by which an inclination **5*b* is arranged on the hinge 5, which likewise prevents a jamming in the above described type. Here the inclination 5*b* enable the inner-lying end of the guide opening 10 not to jam behind the hinge 5, but during closing of the umbrella enables it to slide freely on the fork 4**.

FIG. 8 illustrates that the previously described embodiments and movements of the control rod 9 can be used not only with a telescopic umbrella with a foldable-down outermost blade part 7, but also with a so-called scissors-joint umbrella. With an umbrella of this type, the middle part 6 is articulated on a stretch fork 14 by means of the hinge 5, which stretch fork moreover is connected pivotally with a scissors-jointed fork 15 which extends between the crown 2 and the fork 4.

In spite of the large area opening 10, in order to be able to load the control rod 9 with compressive forces or pressure in the opening position of the umbrella, whereby, for example, an increased bending resistance of the entire outer blade system is achieved, the hinge 5 can be provided with a recess **5*a*, in which recess the inner-lying end of the control rod 9 comes to lie with the opened umbrella. By means of the control rod 9 fixed in the recess 5*a*, the possibility exists of additionally supporting the folding hinge 8 and of giving the entire outer blade system an increased stiffness or rigidity. FIGS. 8 and 9 show the catching or engagement of the control rod 9 in respectively one recess 5*a* of the hinge 5, and indeed once with a scissors-joint umbrella (FIG. 8) and on the other hand with a telescopic umbrella (FIG. 9**).

In FIGS. 1 to 9, the guide opening 10 of the control rods under circumstances, respectively, is formed integrally by a plurality of bent-off portions of the inner-lying end of the control rod 9. This is particularly to be recognized in FIG. 2. FIGS. 10 to 13 show two further possibilities of shape for the formation of the guide opening 10.

According to FIGS. 10 and 11, the guide opening 10 can be formed by a guide piece **10*a* mounted on the inner-lying end of the control rod 9, which guide piece has the shape of a closed eye and is fastened, with an attached or formed-on flange piece, on the control rod 9. According to FIG. 12 and 13 the guide opening 10 can be formed by means of a guide fork 10*b*, the fork ends of which are connected with each other by a rivet 10*c***.

We claim:

1. A shortenable umbrella having blades carrying the umbrella canopy, the blades being shortenable by telescoping and/or folding, and having a shortenable rod assembly and a crown secured on the shortenable rod assembly and for each innermost blade at least one fork operatively connected by means of at least one slider, the latter displaceably disposed on the shortenable rod assembly, for pivoting the blades, comprising an innermost blade being pivoted on the crown, an outermost blade having an extension, a middle blade operatively connected to said innermost and outermost blades, respectively, a fork being operatively connected to said blades and to the slider, a control rod operatively connected to said extension of said outermost blade, said outermost blade being hinged foldably onto said middle blade and actuatable therefor by means of said control rod, said control rod having an inner end forming a guide opening, said fork extending through said guide opening, said opening defining an enlarged area in proportion to the cross-section of said fork, whereby said inner end of said control rod is displaceable in a longitudinal direction of said fork and/or of said control rod.

2. The umbrella as set forth in claim 1, wherein said control rod includes a control piece forming said guide opening and a first portion, the latter is connected to said extension of said outermost blade and has an innermost end, said control piece is mounted on said innermost end of said first portion.

3. The umbrella as set forth in claim 1, wherein said inner end of said control rod is formed with a plurality of bent-off portions integrally forming said guide opening in said control rod.

4. The umbrella as set forth in claim 1, wherein said control rod defines a portion having said guide opening, said portion is bent at an acute angle relative to the longitutinal direction of said control rod.

5. The umbrella as set forth in claim 1, further comprising hinge means for pivotally connecting said middle blade with said fork, said hinge means is formed with an inclined portion on a side thereof facing the crown.

6. The umbrella as set forth in claim 1, further comprising hinge means pivotally connecting said middle blade with said fork, said hinge means is formed with a recess, said inner end of said control rod lies in said recess with a stretched-out umbrella.

* * * * *